US005839633A

United States Patent [19]

Fisher

[11] Patent Number: 5,839,633

[45] Date of Patent: Nov. 24, 1998

[54] MULTIMETER BELT HOLSTER

[75] Inventor: Steven William Fisher, Edmonds, Wash.

[73] Assignee: Fluke Corporation, Everett, Wash.

[21] Appl. No.: 902,511

[22] Filed: Jul. 29, 1997

[51] Int. Cl.[6] ..... A45F 3/00

[52] U.S. Cl. ..... 224/675; 224/242; 224/680; 224/904; 224/930

[58] Field of Search ..... 224/911, 242, 224/245, 246, 904, 674, 675, 680, 930

[56] References Cited

U.S. PATENT DOCUMENTS

| | | | |
|---|---|---|---|
| D. 312,534 | 12/1990 | Nelson et al. | D3/105 |
| 4,591,081 | 5/1986 | Bianchi et al. | 224/198 |
| 4,917,281 | 4/1990 | Ostermiller | 224/680 |
| 5,511,703 | 4/1996 | Ryerson | 224/224 |

OTHER PUBLICATIONS

1989 Fluke Test & Measurement Catalog, Fluke Corporation, 1989 Everett, Washington.

*Primary Examiner*—Linda J. Sholl

[57] ABSTRACT

A multimeter holster for securely carrying and easily deploying a multimeter is provided. The holster includes a front member, a rear member, and horizontal member. The front and rear members are attached at the sides to form a pocket for receiving the multimeter. A retaining strap across the bottom opening of the pocket engages the multimeter, thereby securing the multimeter in a fixed position within the pocket. The horizontal member is attached to the back member and wraps laterally around the pocket to capture the test leads of the multimeter and secure them to an outside edge of the pocket. An upper portion of the rear member is folded back and attached to a lower portion by a pair of fasteners to form a channel of selectable width for receiving the belt of the user.

5 Claims, 5 Drawing Sheets

MULTIMETER BELT HOLSTER

BACKGROUND OF THE INVENTION

This invention relates generally to holster apparatus and in particular to an improved belt holster for carrying electronic test instruments such as multimeters.

Multimeters, also called digital multimeters (DMMs), are commonly employed as handheld electronic test tools used for troubleshooting, service, and maintenance of electrical and electronic equipment, including for example, automobiles, heating, ventilation, air conditioning, and refrigeration systems, and electrical power distribution equipment. Multimeters are often carried by trades people, typically in conjunction with a variety of other hand tools, and in cramped, hard to reach areas. It is desirable that the multimeter be securely carried and yet readily deployable when needed to make measurements.

A variety of carrying cases and holsters have been developed for multimeters. U.S. Pat. No. Des. 312,534, "Multimeter Holster", issued Dec. 4, 1990, to Nelson et al. teaches a rubber holster that wraps around a multimeter. The test probes may be retained in slots on the underside of the holster. However, the multimeter holster taught by Nelson et al. does not allow for easy attachment of the multimeter to the belt of the user for transport. Furthermore, the test leads are not secure and may dangle, allowing them to become entangled on adjacent objects, risking damage to the multimeter.

A variety of multimeter carrying cases having belt loops, carrying straps and carrying handles have also been developed that allow for transporting multimeters. However, none of these carrying cases provide for ready deployment from the belt of the user.

Tool belts designed for use by trades people such as electricians have been developed that allow for the ready insertion and removal of tools as they are used. U.S. Pat. No. 5,511,703, "Tradesman's Tool Belt", issued Apr. 30, 1996, to Wayne R. Ryerson, describes a tools belt having tool pockets fitted for various tools. The tool belt, while providing pockets adapted for holding specific tools, does not provide for the easy storage of test probes used on multimeters or the securing of the test leads between the test probes and the multimeter, thus allowing the test leads to dangle and become entangled on adjacent objects. Such tool belts tend to be wider than standard belts, requiring a holster with a wider channel to accommodate the tool belt.

A multimeter adapted for measuring voltage, resistance, and current includes a U-shaped current sensor mounted at one end of the instrument and permanently attached test probes at the other end. The test probes allow for measuring voltage and resistance. The multimeter is intended for use by trades people such as electricians who have a need to carry around a multimeter on their tool belt in a manner that the multimeter is readily deployable yet secure during transport. Therefore, it would be desirable to provide a holster fitted for the multimeter that may be readily attached to a standard belt or a wider tool belt for easy deployment and further allow for the securing of the test leads when the multimeter is inserted in the holster.

SUMMARY OF THE INVENTION

In accordance with the present invention, a holster for a multimeter is provided. The multimeter, particularly one having a U-shaped current sensor on one end and a pair of permanently attached test leads on the other end, must be securely carried while attached to the belt of the user, either on a standard width belt or on a wider tool belt commonly used by trades people, while being readily deployable when needed.

The holster includes a front member, a rear member, and horizontal member, and has a pocket formed by the front and rear members which are attached at the sides. The multimeter is inserted into a top opening of the pocket and pushed down so that the pocket secures the multimeter for secure transport. In the preferred embodiment, the pocket has a bottom opening that allows the U-shaped current sensor to protrude through with a retaining strap spanning the bottom opening to engage the U-shaped current sensor, thereby securing the multimeter in a fixed position within the pocket. In an alternatively embodiment, the pocket has no bottom opening such that the front and rear members are attached at the bottom as well as the sides.

The horizontal member wraps laterally around the pocket to surround the test leads of the multimeter and secure them to an outside surface of the pocket. A fastener mounted on an outside end of the horizontal member secures the horizontal member in a closed position. An upper portion of the rear member is folded back and attached to a lower portion by a pair of fasteners. The channel formed by the back member receives the belt of the user, with the maximum width of the belt determined by the closure of one or both fasteners.

One object of the present invention is to provide a holster for a multimeter.

A further object of the present invention is to provide a holster for securely carrying a multimeter on the belt of the user while allowing for easy deployment of the multimeter when needed.

Another object of the present invention is to provide a holster for a multimeter having a pocket to receive the multimeter and a horizontal member to secure the multimeter test leads.

An additional object of the present invention is to provide a holster for a multimeter having an channel for receiving belts of different widths.

Other features, attainments, and advantages will become apparent to those skilled in the art upon a reading of the following description when taken in conjunction with the accompanying drawings.

DETAILED DESCRIPTION OF THE INVENTION

Figure 1:
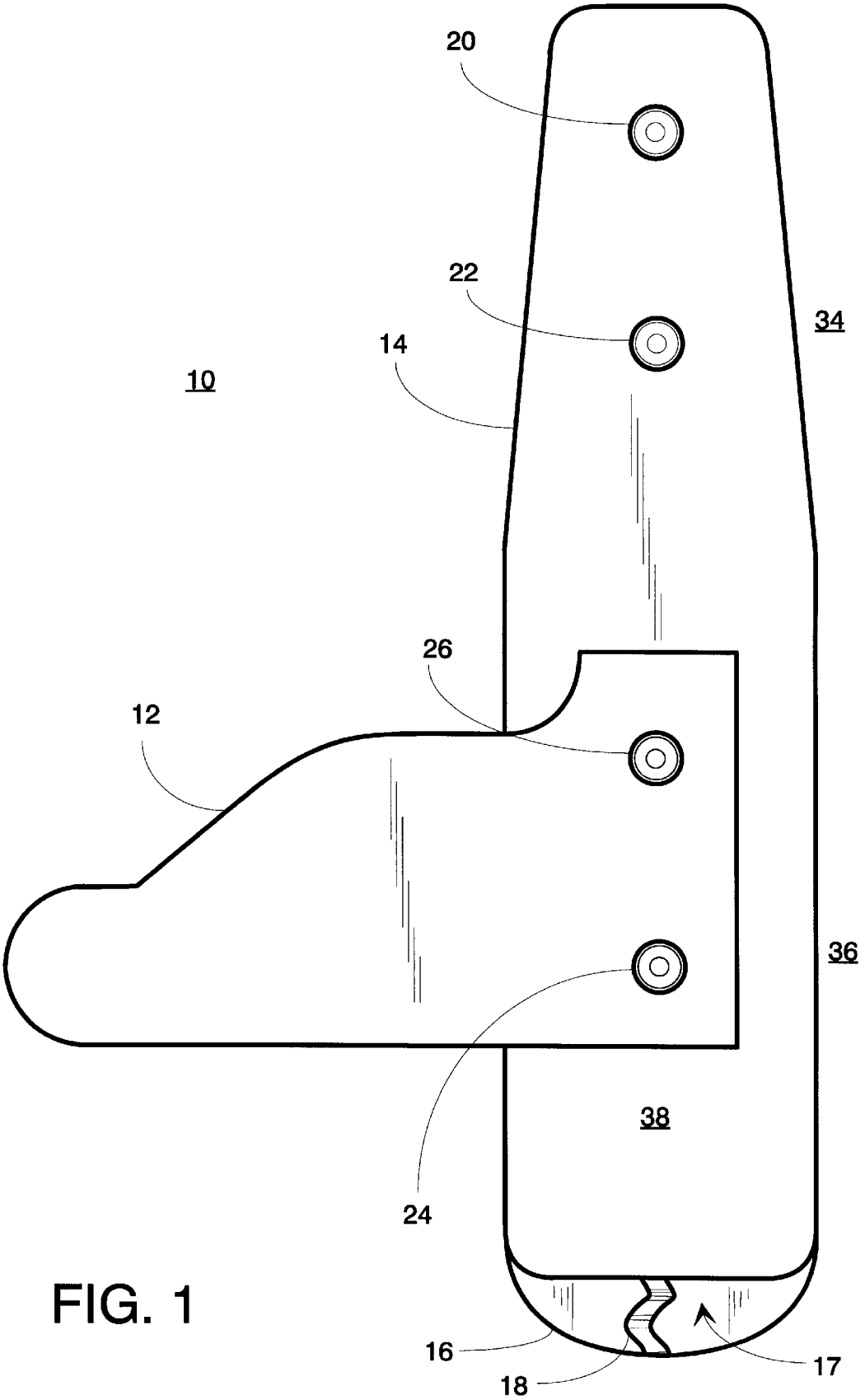
FIG. 1 is a rear plan view of a multimeter holster in an unfolded position according to the present invention.

In FIG. 1, there is shown a rear plan view of a multimeter holster 10 in an unfolded position. A horizontal member 12 is attached to a rear member 14. The rear member 14 has an upper portion 34 and a lower portion 36. A front member 16 is attached to the lower portion 36 of the rear member 14 along each side to form a pocket 38 having a bottom opening 17. A retaining strap 18 spans the bottom opening 17, preferably from the rear member 14 to the front member 16. Alternatively, the pocket 38 has no bottom opening 17, with the rear member 14 and front member 16 attached along the bottom as well as the sides, with no retaining strap 18.

First and second fasteners 20 and 22 are attached to the upper portion 34 of the rear member 14. First and second mating fasteners 24 and 26 are attached to the lower portion 36 of the rear member 14 and are spaced to engage with the first and second fasteners 20 and 22 respectively. The rear member 14, front member 16, and horizontal member 12 are preferably constructed of durable, flexible material such as nylon and attached together with stitching. Alternatively, the rear member 14, front member 16, and horizontal member 12 may be constructed with a single piece of material to form the pocket 38 and horizontal member 12. The first and second fasteners 20 and 22 and the first and second mating fasteners 24 and 26 are preferably metal snap-type fasteners that are readily available. Other fastener types such as buttons or Velcro may be readily substituted.

Figure 2:
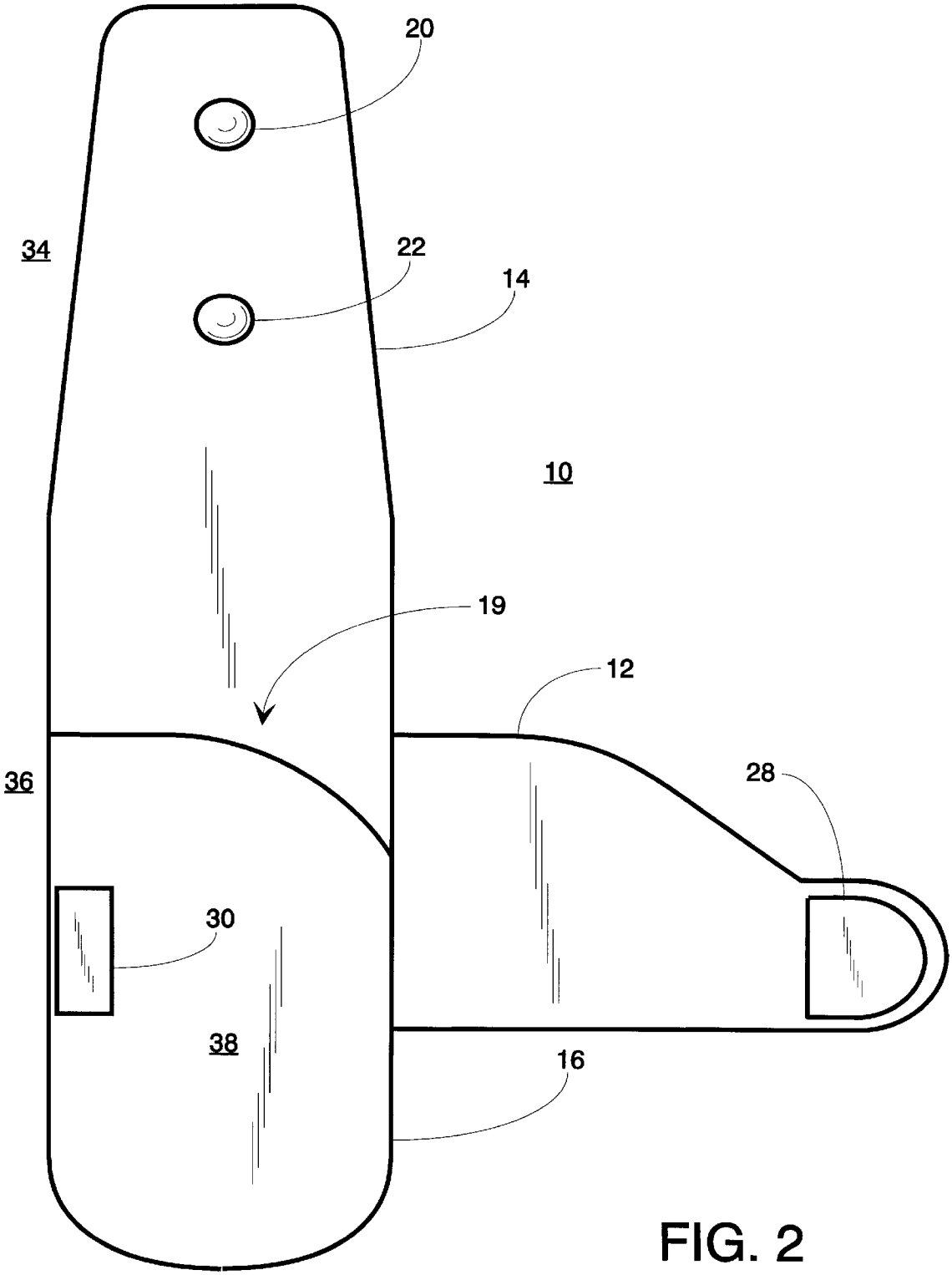
FIG. 2 is a front plan view of the multimeter holster of FIG. 1.

FIG. 2, there is shown a front plan view of the multimeter holster 10 in the unfolded position. The front member 16 and a top opening 19 of the pocket 38 are shown. The first and second fasteners 20 and 22 are shown as metal snaps. A third fastener 28 is mounted on an outside edge of the horizontal member and a third mating fastener 30 is mounted on the front member 16. The third fastener 28 and third mating fastener 30 are preferably of Velcro material. Other fastener types such as buttons, clasps or metal snaps may be readily substituted.

Figure 3:
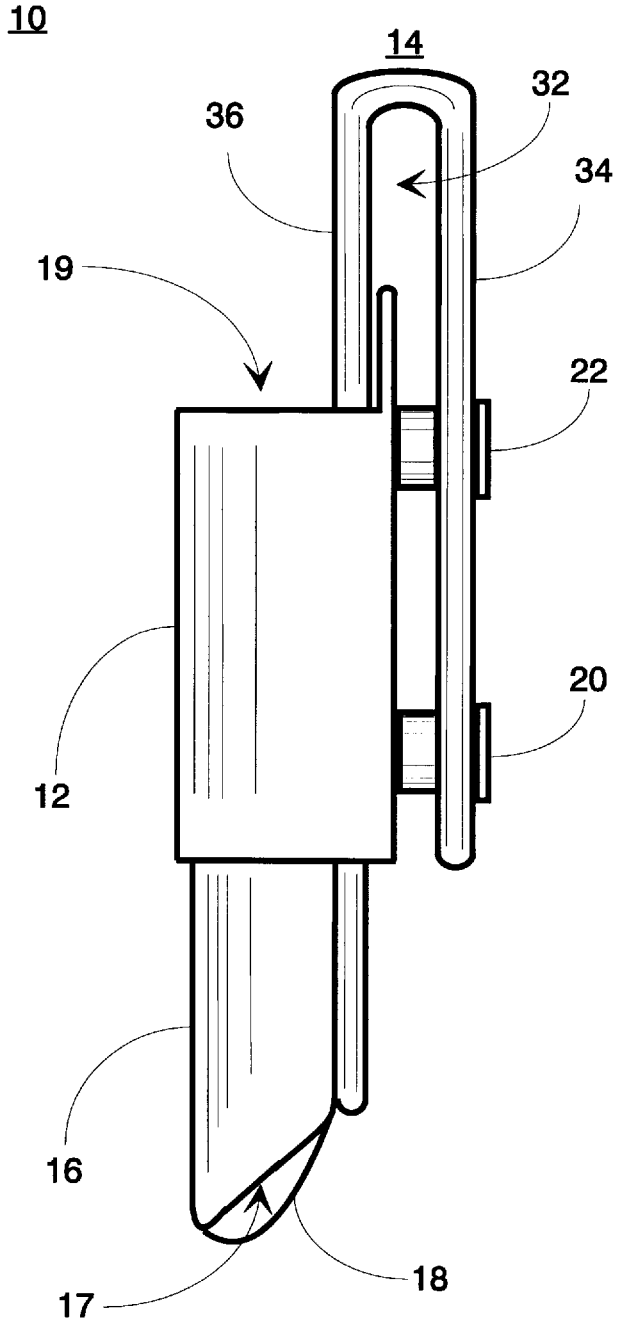
FIG. 3 is a right side view of the multimeter holster in a folded position.

In FIG. 3, there is shown a side plan view of the multimeter holster 10 in a folded position in which the upper portion 34 of the rear member 14 is folded back around to the lower portion 36 to form a channel 32 for receiving a belt, strap, or waistband of the user. The first and second fasteners 20 and 22 are attached to the first and second mating fasteners 24 and 26 respectively. The channel 32 may be widened to receive a wider tool belt by separating the second faster 22 from the second mating fastener 26. The lower portion 36 may also be adapted to contain an internal stiffener, constructed of metal or thick plastic for example, that provides additional protection for the multimeter when inserted in the holster 10 for transport.

Figure 4:
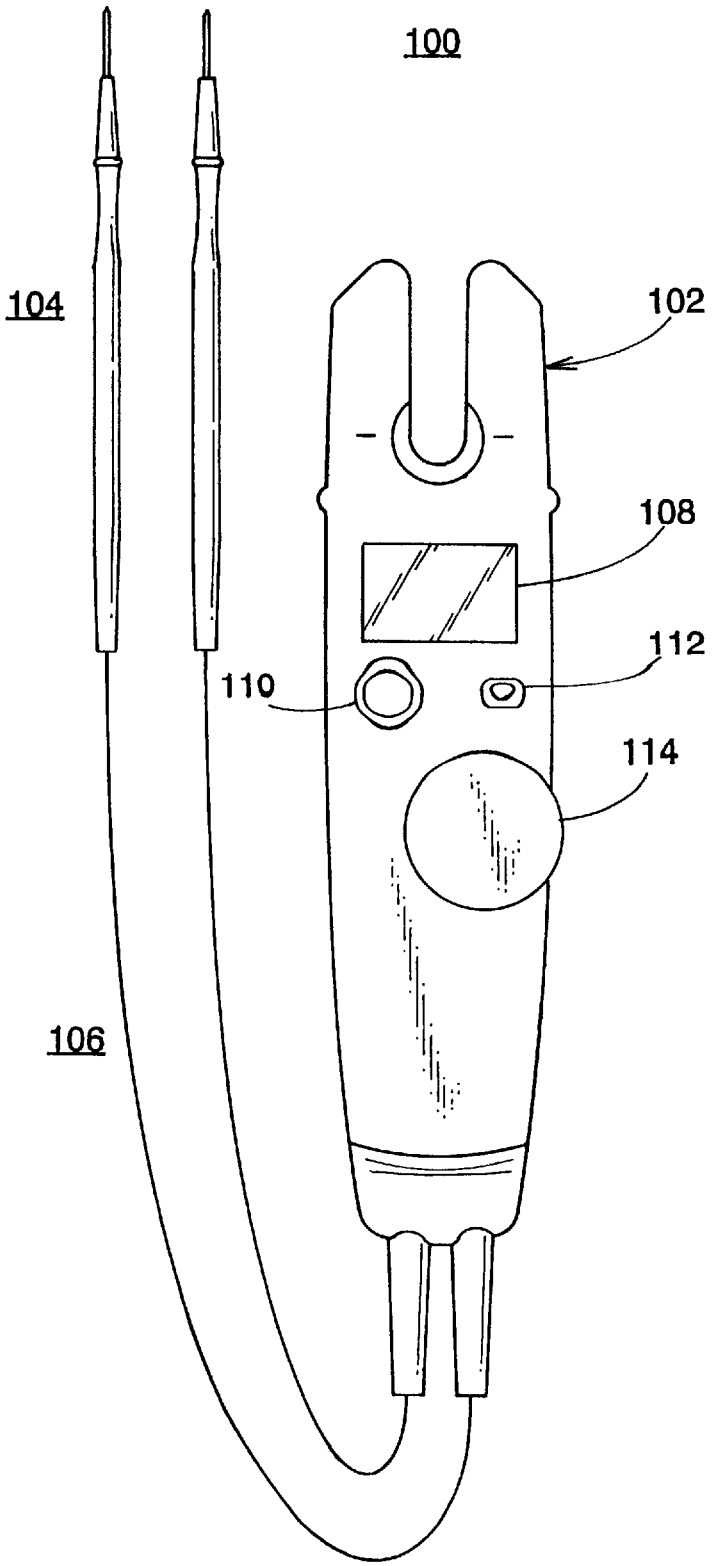
FIG. 4 is a front plan view of a multimeter having a U-shaped current sensor and permanently attached test leads.

In FIG. 4, there is shown a multimeter 100 that is an example of the type of multimeter 100 that is desirable to carry in the multimeter holster 10 (not shown) of the present invention. The multimeter 100 has a U-shaped current sensor 102 at one end and a pair of test probes 104 connected to the other end via a pair of test leads 106. On a top surface of the multimeter 100 are mounted a display 108, button 110, indicator 112, and rotary knob 114 which comprise a user interface. On a bottom surface (not shown) of the multimeter 100, the pair of test probes 104 may be secured in a pair of slots. It is desirable that the user interface of the multimeter 100 be protected while the multimeter 100 is inserted in the multimeter holster 10. It is further desirable that the test leads 106 be captured and secured against dangling to protect the test leads 106 from becoming entangled on external objects when the multimeter 100 is secured in the multimeter holster 10.

Figure 5:
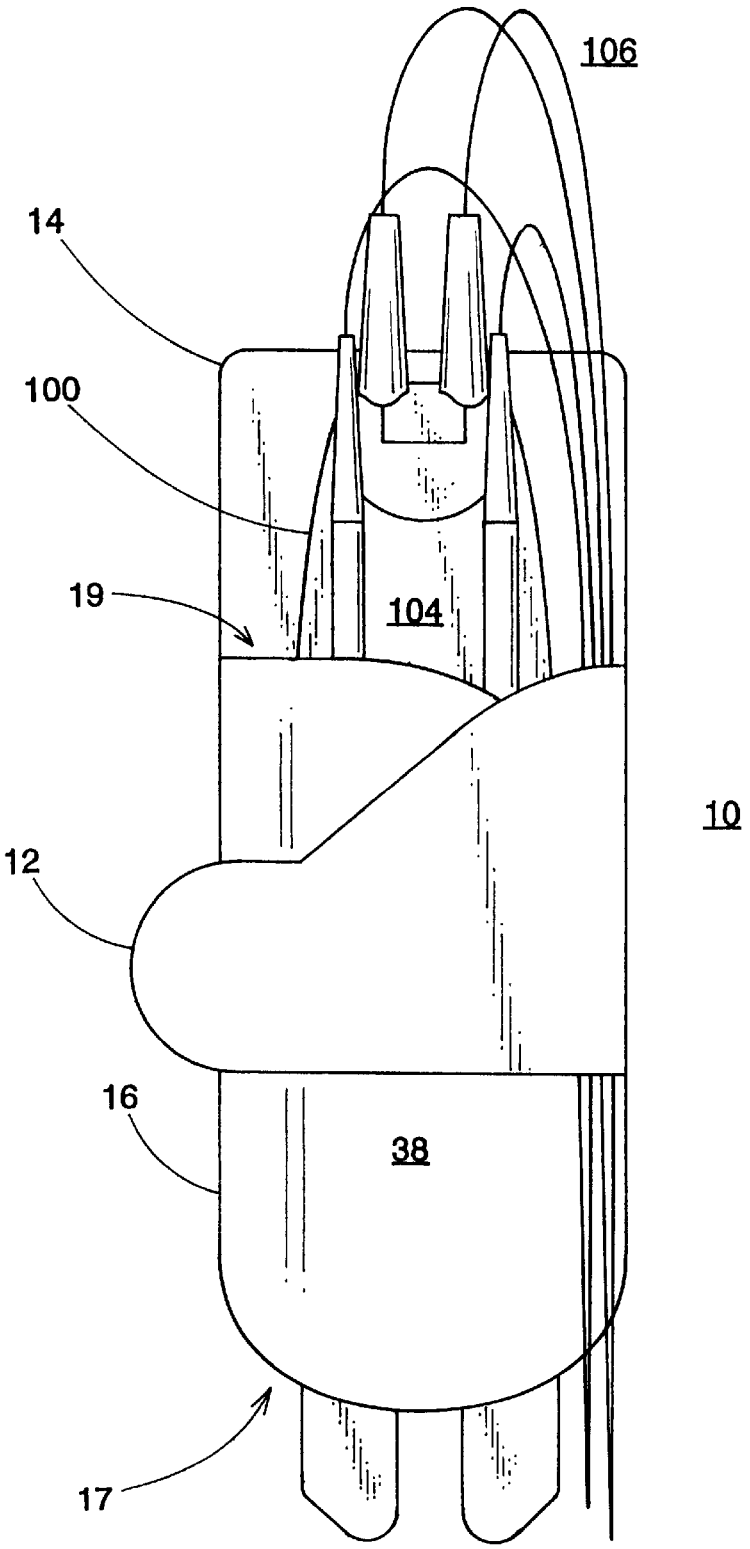
FIG. 5 is a front plan view of the multimeter of FIG. 4 placed in the multimeter holster of the present invention for secure transport and easy deployment.

In FIG. 5, the multimeter 100 of FIG. 4 is inserted in top opening 19 of the multimeter holster 10, with the current sensor 102 protruding from the bottom opening 17. The test probes 106 are shown mounted to a rear surface of the multimeter 100, with the front surface of the multimeter 100 preferably facing the rear member 36 containing the stiffener to better protect the user interface. The current sensor 102 is engaged by the retaining strap 18 to securely position the multimeter 100 in the pocket 38. The circumference of the pocket 38 is preferably sized to fit the multimeter 100 securely to prevent the multimeter 100 from falling out if the multimeter holster 10 is inverted. The test leads 106 are captured to minimize dangling by the horizontal member 12 which wraps around the pocket 38 in the closed position. The horizontal member 12 is held in place in the closed position by engaging third fastener 28 with the third mating fastener 30.

It will be obvious to those having ordinary skill in the art that many changes may be made in the details of the above described preferred embodiments of the invention without departing from the spirit of the invention in its broader aspects. For example, the multimeter holster 10 may be constructed of any of a variety of materials commonly employed in holsters, such as plastic, nylon, and leather, with the selection governed by cost, durability, and ease of manufacture. Likewise, the choice of fasteners is governed by cost, durability, and ease of manufacture. The multimeter holster may be readily adapted to fit other multimeter types as well as other types of electronic instruments where it is desirable to capture the test leads while allowing for easy deployment. The retaining strap may readily engage the bottom edge of multimeters not having a U-shaped current sensor. Therefore, the scope of the present invention should be determined by the following claims.

What I claim as my invention is:

1. A multimeter holster, comprising:

(a) a rear member having an upper portion and a lower portion wherein said upper portion is folded back on said lower portion to form a channel for receiving a belt;

(b) a front member attached to said lower portion to form a pocket, said pocket comprising a top opening to receive said multimeter; and (c) a horizontal member fixedly attached at one end to said lower portion and having a free end that wraps laterally around said pocket and releasably attaches to said front member wherein said horizontal member captures test leads from said multimeter in a closed position.

2. A multimeter holster according to claim 1, said pocket further comprising a bottom opening, and said multimeter holster further comprising a retaining strap spanning said bottom opening to engage said multimeter.

3. A multimeter holster according to claim 1, further comprising:

(a) first and second fasteners on said upper portion; and (b) first and second mating fasteners on said lower portion for engaging said first and second fasteners respectively to form said channel.

4. A multimeter holster according to claim 3 wherein said channel is adjustable to accept said belt in narrow and wide widths.

5. A multimeter holster according to claim 1 further comprising:

(a) a fastener on said outer edge of said horizontal member; and (b) a mating fastener on said pocket for engaging said fastener when said horizontal member is in said closed position.

* * * * *